US006964074B2

(12) United States Patent
Carlitz

(10) Patent No.: US 6,964,074 B2
(45) Date of Patent: Nov. 15, 2005

(54) ANTI-MICROBIAL/-ALLERGENIC MATTRESS AND PROCESS OF FORMING THEREOF

(75) Inventor: Stuart Scott Carlitz, Holland, PA (US)

(73) Assignee: Mattress Development Company, LLC, Wilmington, DE (US)

( * ) Notice: Subject to any disclaimer, the term of this patent is extended or adjusted under 35 U.S.C. 154(b) by 193 days.

(21) Appl. No.: 10/638,796

(22) Filed: Aug. 11, 2003

(65) Prior Publication Data

US 2005/0034243 A1 Feb. 17, 2005

(51) Int. Cl.[7] ..... A47C 27/05; A47C 27/045; A47C 23/04

(52) U.S. Cl. ..... 5/699; 5/939; 5/737; 5/500; 5/717; 5/721

(58) Field of Search ..... 5/699, 939, 737, 5/482, 499, 500, 716, 717, 721, 655.7

(56) References Cited

U.S. PATENT DOCUMENTS

| | | | | | |
|---|---|---|---|---|---|
| 2,978,715 | A | * | 4/1961 | Blecker | 5/716 |
| 3,055,021 | A | * | 9/1962 | Rymland et al. | 5/716 |
| 3,173,159 | A | * | 3/1965 | Hart | 5/717 |
| 3,256,535 | A | * | 6/1966 | Anson | 5/716 |
| 3,493,980 | A | * | 2/1970 | Haller | 5/716 |
| 3,950,800 | A | * | 4/1976 | Garshfield | 5/738 |
| 4,286,344 | A | * | 9/1981 | Ikeda | 5/717 |
| 4,463,466 | A | * | 8/1984 | May et al. | 5/721 |
| 4,476,595 | A | * | 10/1984 | Ikeda | 5/721 |
| 4,788,731 | A | * | 12/1988 | Yokoi et al. | 5/721 |
| 4,809,375 | A | * | 3/1989 | Bull | 5/722 |
| 5,050,256 | A | * | 9/1991 | Woodcock | 5/699 |
| 5,321,861 | A | * | 6/1994 | Dancey et al. | 5/482 |
| 5,432,964 | A | * | 7/1995 | Strell | 5/716 |
| 5,435,026 | A | * | 7/1995 | Cavazos | 5/716 |
| 5,644,811 | A | * | 7/1997 | Cavazos | 5/738 |
| 5,768,726 | A | * | 6/1998 | Myles | 5/737 |
| 5,896,605 | A | * | 4/1999 | Branman | 5/716 |
| 5,950,264 | A | * | 9/1999 | Wyner et al. | 5/690 |
| 5,966,759 | A | * | 10/1999 | Sanders et al. | 5/499 |
| 6,017,601 | A | * | 1/2000 | Amsel | 428/36.1 |
| 6,023,803 | A | * | 2/2000 | Barman | 5/716 |
| 6,174,584 | B1 | * | 1/2001 | Keller et al. | 428/102 |
| 6,256,816 | B1 | * | 7/2001 | Law | 5/482 |

(Continued)

OTHER PUBLICATIONS

Terreehorst et al., "Evaluation of Impemeable Covers for Bedding In Patients with Allergic Rhinitis", The New England Journal of Medicine, vol. 349, No. 3, Jul. 17, 2003, pp. 237–246.

Woodcock et al., "Control of Exposure to Mite Allergen and Allergen–Impermeable Bed Covers for Adults with Asthma", The New England Journal of Medicine, vol. 349, No. 3, Jul. 17, 2003, pp. 225–236.

Article—"Mite–proof bedding may not help allergies", Dayton Daily News, Jul. 17, 2003, p. A4.

*Primary Examiner*—Robert G. Santos
(74) *Attorney, Agent, or Firm*—Dinsmore & Shohl LLP

(57) ABSTRACT

An anti-microbial/-allergenic sleep set and process of forming thereof is provided and comprises a mattress and box spring, each having an allergen-impermeable barrier layer incorporated within. The mattress comprises a support apparatus, a top and bottom panel, first and second flanges, a border, a foam layer, and a barrier layer. The border is positioned around the support apparatus, and is attached to the top and bottom panels. The foam layer, which can comprise a latex emulsion, is positioned between the support apparatus and the top and bottom panels. The barrier layer comprises a material configured to be impermeable by allergens, and is attached at its outer periphery to the interior facing sides of the top panel, the bottom panel, and the border.

22 Claims, 4 Drawing Sheets

U.S. PATENT DOCUMENTS 6,277,770 B1 * 8/2001 Smith et al. ..... 442/190
6,360,388 B2 * 3/2002 Langer ..... 5/632
6,363,553 B1 * 4/2002 Baumgartel et al. ..... 5/482
6,618,880 B1 * 9/2003 Chase ..... 5/500
2001/0009043 A1 * 7/2001 Langer ..... 5/632
2001/0039157 A1 * 11/2001 Smith et al. ..... 442/190
2002/0148047 A1 * 10/2002 Corzani et al. ..... 5/738
2002/0178506 A1 * 12/2002 Corzani et al. ..... 5/737
2003/0121101 A1 * 7/2003 Corzani et al. ..... 5/487
2003/0163870 A1 * 9/2003 Porter et al. ..... 5/490
2003/0172458 A1 * 9/2003 Bonfanti et al. ..... 5/490
2004/0074006 A1 * 4/2004 Patten ..... 5/717
2004/0088790 A1 * 5/2004 Chase ..... 5/484

* cited by examiner

ANTI-MICROBIAL/-ALLERGENIC MATTRESS AND PROCESS OF FORMING THEREOF

BACKGROUND OF THE INVENTION

The present invention relates generally to mattress construction and, more particularly, to an anti-microbial/-allergenic mattress and process of forming thereof.

Materials utilized in the construction of ordinary sleep sets (mattress and box spring) provide an environment that is favorable to the growth and development of bacteria, dust mites, mold, mildew, and other microscopic particles and organisms, which cause airborne allergenic symptoms in millions of humans annually. Accordingly, known in the art are a variety of after-market, tightly woven encasings and covers that surround the exterior surface of the sleep set. The manufacturers of these after-market encasings purport that they provide an "allergy-free" barrier to aero-allergenic microorganisms.

However, these after-market encasings do not prevent the multiplication of microorganisms that permeate the mattress prior to the installation of the encasing. In addition, the encasings must have a zipper or other like means that enable its installation and closure around the sleep set. This closure means does not sufficiently block the passage of microorganisms and other adjuvant factors, which easily penetrate small voids. Additionally, due to the fact that these enclosures are installed post-manufacturing, there is a potential for dust mites and other allergens to become trapped inside of the mattress once the after-market enclosure is installed. Furthermore, studies have indicated that allergen-impermeable covers, as a single intervention for the avoidance of exposure to dust mite allergen (*Dermatophagoides pteronyssinus* 1), seem clinically ineffective in adults with asthma (Woodcock, A., et al., (2003). Control of Exposure to Mite Allergen and Allergen-Impermeable Bed Covers for Adults with Asthma. *N Engl J Med* 348: 225–236). Moreover, this single avoidance measure of installing an after-market encasing did not lead to a significant improvement of clinical symptoms in patients with allergic rhinitis (Terreehorst, I., et al., (2003). Evaluation of Impermeable Covers for Bedding in Patients with Allergic Rhinitis. *N Engl J Med* 349: 237–236).

Therefore, the present inventor has recognized a need for improvements in anti-microbial/-allergenic mattress design.

SUMMARY OF THE INVENTION

The present invention meets the above-mentioned need by providing a sleep set and process of forming thereof that defines an anti-microbial/-allergenic barrier fabric incorporated within the interior of the mattress and box spring. This barrier fabric encapsulates all of the filling materials as well as the support apparatus of the mattress, thus creating a truly impermeable barrier to allergenic microorganisms and particles at the time of manufacture.

Although the present invention is not limited to specific advantages or functionality, it is noted that the combination of materials and manufacturing process will provide an allergen-free environment within the confines of the mattress, therefore effecting aero-allergen avoidance and reducing the likelihood of allergenic symptoms in the sleeper. The barrier fabric will prevent dust mites from penetrating the upholstery layers of the mattress. The upholstery layers are constructed from 100% pure, naturally non-allergenic, latex foam rubber that prevents the growth of bacteria, dust mites, mold and mildew. No urethane foam or fiber clipping materials are used in the construction of the mattress. The barrier fabric that seals the layers of upholstery also protects individuals having potential allergies to latex.

In accordance with one embodiment of the invention, a mattress is provided comprising a support apparatus, top and bottom panels, a border, a foam layer, a barrier layer, and at least one flange. The top panel defines an interior facing side and is positioned above the support apparatus. The bottom panel defines an interior facing side and is positioned below the support apparatus. The border, which has an interior facing side, is positioned around the support apparatus and is attached to the top and bottom panels. The foam layer is positioned between the support apparatus and the top and bottom panels. The barrier layer, which comprises a material configured to be impermeable by allergens, is attached at its outer periphery to the interior facing sides of the top panel, the bottom panel, and the border. The flange is configured to secure the top panel, the bottom panel, or the border to the support apparatus.

In accordance with another embodiment of the invention, a box spring is provided comprising a frame, a mattress support deck, a box cover, a pad, and a barrier layer. The box cover comprises a top panel, a bottom panel, and a border, each having an interior facing side. The top panel is positioned above the mattress support deck and the frame. The bottom panel is positioned below the mattress support deck and the frame. The border is positioned around the mattress support deck and the frame, and is attached to the top panel and the bottom panel. The pad is positioned between the mattress support deck and the top and bottom panels. The barrier layer comprises a material configured to by impermeable by allergens, wherein the barrier layer is attached at its outer periphery to the interior facing sides of the top panel, the bottom panel, and the border.

In accordance with yet another embodiment of the invention, a sleep set including a mattress and box spring is provided, wherein the mattress and the box spring each have an allergen-impermeable barrier layer incorporated within.

In accordance with still another embodiment of the invention, a process of forming a mattress having an allergen-impermeable barrier layer incorporated within is provided comprising providing a support apparatus having top and bottom surfaces; providing a layer of foam and positioning the foam adjacent the top and bottom surfaces of the support apparatus; providing a top panel having an interior facing side and a first flange attached, a bottom panel having an interior facing side and a second flange attached, and a border having an interior facing side; serging the barrier layer at its outer periphery to the interior facing sides of the top panel, the bottom panel, and the border; securing the top and bottom panels above and below the support apparatus and the foam layer, respectively, by securing the first and second flanges to the support apparatus; and closing the mattress by attaching the border to the top and bottom panels by serging, thus enclosing the support apparatus and the foam layer within the barrier layer.

These and other features and advantages of the invention will be more fully understood for the following detailed description of the invention taking together with the accompanying drawings. It is noted that the scope of the claims is defined by the recitations therein and not by the specific discussion of features and advantages set forth in the present description.

BRIEF DESCRIPTION OF THE DRAWINGS

The following description of the embodiments of the present invention can be best understood when read in conjunction with the following drawings, where like structure is indicated with like reference numerals and in which.

Skilled artisans appreciate that elements in the figures are illustrated for simplicity and clarity and have not necessarily been drawn to scale. For example, the dimensions of some of the elements in the figures may be exaggerated relative to other elements, and with conventional parts removed, to help to improve understanding of embodiments of the present invention.

DETAILED DESCRIPTION OF THE INVENTION

Figure 1:
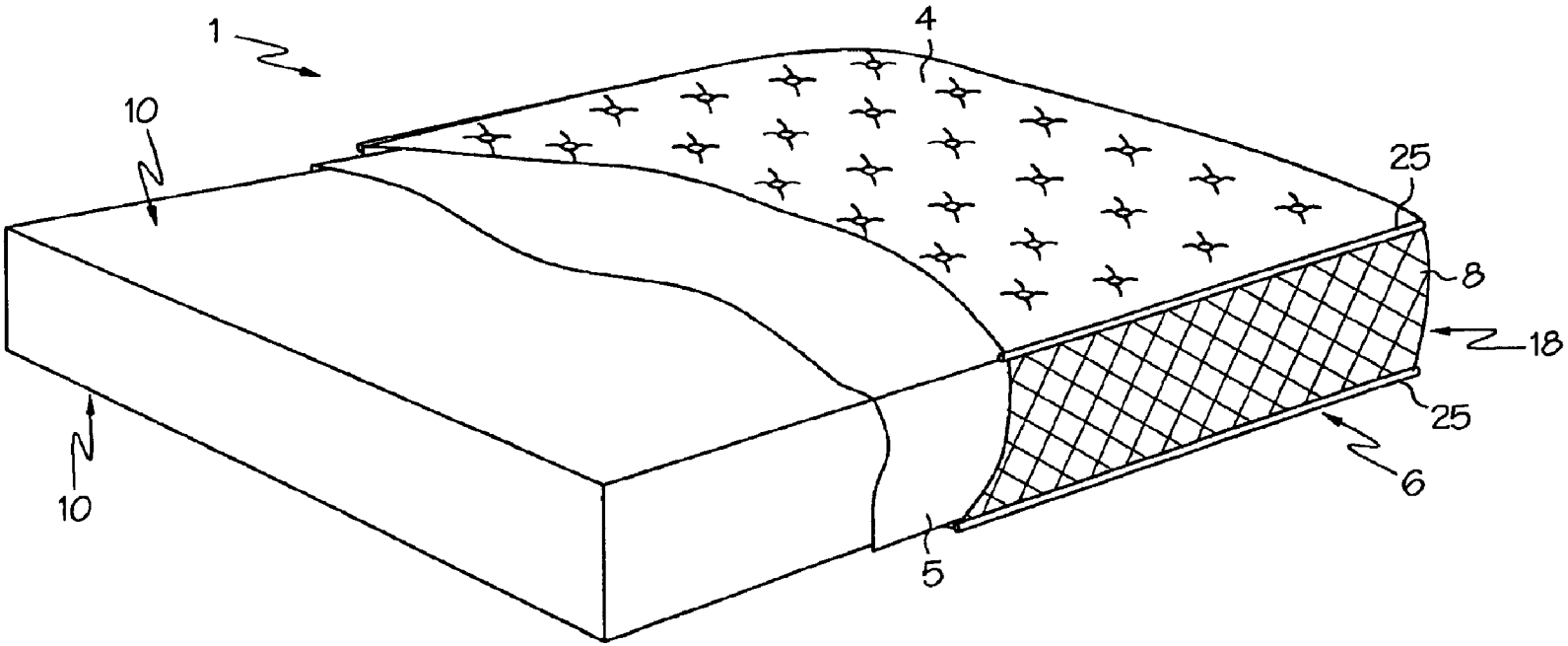
FIG. 1 is a schematic, perspective view of an anti-microbial/-allergenic mattress shown in accordance with one embodiment of the present invention, which has been partially cut away for convenience of illustration.
Figure 2:
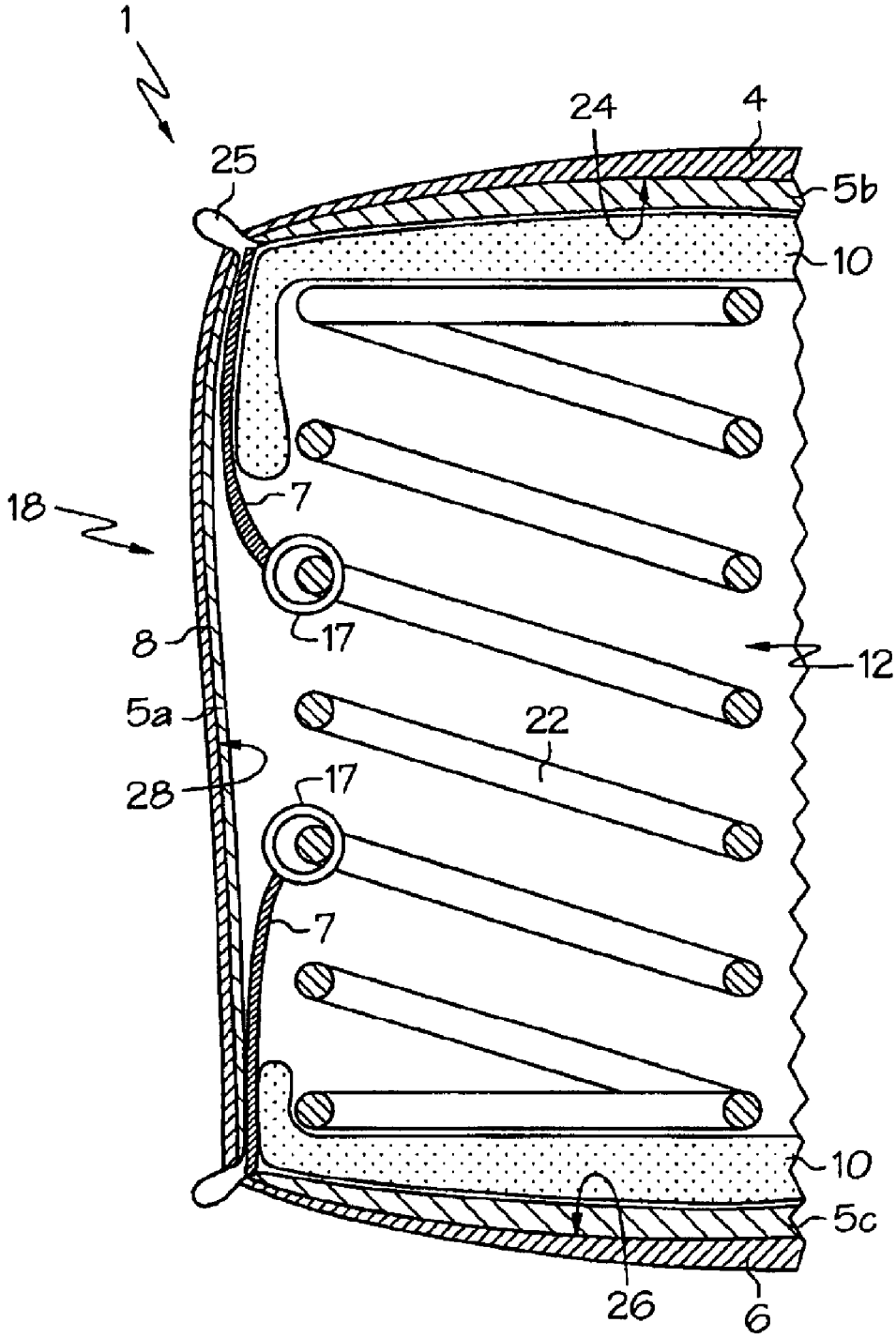
FIG. 2 is a schematic, cross-sectional view of an anti-microbial/-allergenic mattress shown in accordance with one embodiment of the present invention.

Referring initially to FIGS. 1 and 2, in accordance with one embodiment of the invention, a mattress 1 is shown having a top panel 4 and a bottom panel 6, which is best shown by FIG. 2. The top and bottom panels 4, 6 form top and bottom exterior surfaces of the mattress 1, respectively. A border 8 is positioned around the outer perimeter of the mattress 1, forming a lateral side 18 between the top panel 4 and the bottom panel 6. As is described in further detail below, the border 8 is joined with the top and bottom panels 4, 6 sealing the interior components of the mattress 1 therein. The peripheries of the top and bottom panels 4, 6 can define tape binding or edging 25 that is used to form welts. The top and bottom panels 4, 6 as well as the border 8 can all be manufactured from a chemical-free, 100% cotton damask material, which material can be pre-cut for standard mattress sizes prior to assembly.

In accordance with the present invention, the mattress 1 comprises the following preferred components, which are further illustrated in FIG. 2. The border 8 has an interior-facing or enclosed side 28 that faces the interior cavity of the mattress 1. The top and bottom panels 4, 6 also define interior-facing or enclosed sides 24, 26, respectively. A barrier layer 5 is attached along its outer periphery to the interior-facing sides 24, 26, 28 of the top and bottom panels 4, 6 and border 8, respectively, which barrier layer 5 can be manufactured from a synthetic, anti-microbial/-allergenic material comprising a plurality of tightly woven fibers. Suitable anti-microbial/-allergenic material for forming the barrier layer 5 can include, but is not limited to, tightly woven polyester materials such as Dacron®, which is available from E. I. du Pont de Nemours and Company (Wilmington, Del.). In addition, the barrier layer 5 can further comprise an optional film or laminate on one or both of its interior or exterior facing sides, which laminate can comprise, for example, a synthetic thermoplasic or thermosetting polymer, such as, for example, polyurethane, polyethylene, polypropylene, polyester, polytetrafluoroethylene, polyvinyl chloride, etc. Typically, the laminate is a monolithic, semi-breathable material having high moisture-proofness, which protects the interior components of the mattress 1 (upholstery and support apparatus) from spills, etc. The laminate also provides additional protection from the passage of dust mites and other allergens. Suitable barrier layers 5 with a synthethic laminate are available from Narcote, LLC (Piney Flats, Tenn.), such as, for example, 404 TU, 800 TU, or 5050 TU. While not intended to limit the present invention to any particular barrier layer 5, typical physical properties for an anti-microbial/-allergenic material are presented in Table 1 below.

TABLE 1

Typical Physical Properties of an Anti-microbial/-allergenic Material

| Product Information | 5050 TU |
|---|---|
| Width | 63" and 81" |
| Weight | 3.3 oz/yd$^2$ |
| Laminate Thickness | 25$\mu$ |
| Total Count | 140 |
| Construction | Woven |
| Mean Flow Pore Diameter | 0 |
| MVTR (ASTM E96B) | 270 |
| Feline Allergen (Fel d1) | <0.31 |
| Dust Mite Allergen (Der f1) | <1.3 |
| Bursting Strength, PSI | >40 PSI |

As further illustrated in FIG. 2, a layer of foam padding 10 is placed on both sides of a support apparatus, such as, for example, a coil spring system 12, between it and the top and bottom panels 4, 6. Although not shown in FIG. 2, the mattress 1 can further comprise additional padding and filling materials, as well as a plastic or wire grid placed between the coil spring system 12 and padding 10, as is commonly employed in the art. It is also contemplated that additional barrier layers of different or same materials can be incorporated during construction of the mattress 1. The foam padding 10 is manufactured from a naturally non-allergenic, latex foam rubber emulsion that is effective in preventing the growth of bacteria, dust mites, mold, mildew and other allergenic substances and microorganisms.

As further illustrated in FIG. 2, the top and bottom panels 4, 6 can each have at least one flange 7 attached thereto, which flange 7 can be attached at an opposite terminal end by hog ringing 17 to a spring 22 of the coil spring system 12. The flange 7 can be comprised of non-woven material that is well known to those skilled in the art and provides means for securing the top and bottom panels 4, 6, the barrier layer 5, and the latex foam 10 over the coil spring system 12. Although a single, quilted, chemical-free, 100% cotton damask material is described and shown herein for the top and bottom panels 4, 6 and border 8, it is contemplated that different combinations of fabric types may be employed, which are non-allergenic in association with the present invention. The tape binding 25 may be comprised of coordinating or contrasting fabric and colors in relation to the panels 4, 6 and border 8. Moreover, the welts that can be formed around the perimeters of the top and bottom surfaces of the mattress 1 by serging of the tape 25 as described in further detail below, may be replaced with cording, by fabric itself (self welts), or even eliminated, as is well known to those skilled in the art. Although not shown in FIG. 2, still additional components can be added between the spring system 12 and the border 8 including wads of non-allergenic cotton material (at the corners) and support members (along the mattress perimeter).

In accordance with another embodiment of the present invention, a process of forming a non-microbial/-allergenic mattress is provided. The components making up the mattress 1 are configured as described herein and are available from various sources known to those skilled in the art. Initially, the coil spring system 12 comprising a plurality of springs 22, and the latex foam 10 are provided, and the foam 10 is positioned adjacent the top and bottom surfaces of the spring system 12 (see FIG. 2). Next, the top and bottom panels 4, 6, the barrier layer 5, and the border 8 are provided, which have been cut to predetermined sizes. In this regard, the top and bottom panels 4, 6 are cut so that they cover the top and bottom surfaces of the coil spring system 12, respectively, and the border 8 is cut so that it forms the lateral side 18 of the mattress 1 once constructed. The barrier layer 5 can define first, second and third substantially rectangular sections 5*a*, 5*b*, 5*c*, which as indicated herein can be comprised of an anti-microbial/-allergenic material, which is impermeable by allergenic microbes. The first barrier layer 5*a* can be cut so that it corresponds to the dimensions of the border 8, and the second and third barrier layers 5*b*, 5*c* can be cut to correspond to the dimensions of the top and bottom panels 4, 6, respectively.

The first barrier layer 5*a* is positioned adjacent the interior facing side 28 of the border 8 and then attached thereto by serging (sewing) around the outer periphery using an automatic border serging machine and common techniques known to those skilled in the art of mattress construction. In a similar manner, the second and third barrier layers 5*b*, 5*c* are serged at their outer peripheries to the enclosed or interior facing sides 24, 26 of the top and bottom panels 4, 6, respectively. In addition, one terminal end of the flange material 7 can be attached to the outer perimeter of each of the panels 4, 6 (see FIG. 2). Attachment of the flange material 7 to the top and bottom panels 4, 6 can be done simultaneously with the serging of the barrier layer 5, or as a separate step.

The top and bottom panels 4, 6 and adjacent second and third barrier layers 5*b*, 5*c* are positioned above and below the coil spring system 12, respectively, and attached to the mattress 1 by securing an opposite terminal end of each flange 7 to a spring 22 using hog rings 17 or other like fasteners. Accordingly, the top and bottom panels 4, 6 secure the latex foam 10 and any other optional filling/padding materials or grid over the coil spring system 12 by use of the flange 7. The mattress 1 is then closed by attaching the border 8 and adjacent first barrier layer 5*a* to the top and bottom panels 4, 6 and their adjacent second and third barrier layers 5*b*, 5*c* using conventional tape binding and serging methods, and therefore extending the border 8 over the flange 7 and encapsulating the coil spring system 12, latex foam 10, and other optional filling materials within the barrier layer S.

In accordance with the present invention, it is further contemplated that instead of employing first, second and third barrier layers 5*a*, 5*b*, 5*c* the barrier layer 5 can optionally define an encasing, which encasing is configured surround the support apparatus and latex foam 10. The barrier layer 5 which has been fashioned as an encasing, can then be serged at its outer periphery to the enclosed or interior facing sides 24, 26, 28 of the top and bottom panels 4, 6 and border 8, respectively.

The barrier layer 5, which is incorporated into the mattress 1 during its construction, creates an impermeable seal to allergenic micro particles and microorganisms, which commonly gather near about the center of the mattress 1. Rather than by quilting the top and bottom panels 4, 6 and border 8 to the barrier layer 5, the integrity of the barrier 5 is maintained by serging only at its very outer perimeter. The chances of micro-allergens penetrating the barrier layer 5 at the outer perimeter where it is serged to the top and bottom panels 4, 6 and border 8 is further diminished by tape edging the mattress 1 using materials and methods commonly employed in the art. Unlike after-market encasings and covers that are sewn from within (inside stitched) and positioned outside of the mattress after manufacture, by tape edging the mattress 1 at the outer perimeter of the barrier 5, top and bottom panels 4, 6 and border 8, a relative fusion of materials occurs due to the pressure applied by the tape edge 25, which covers the site where the mattress 1 is closed by serging. Accordingly, no micro-allergens are able to penetrate the barrier layer 5, creating a true allergen-free environment within the mattress 1.

Figure 3:
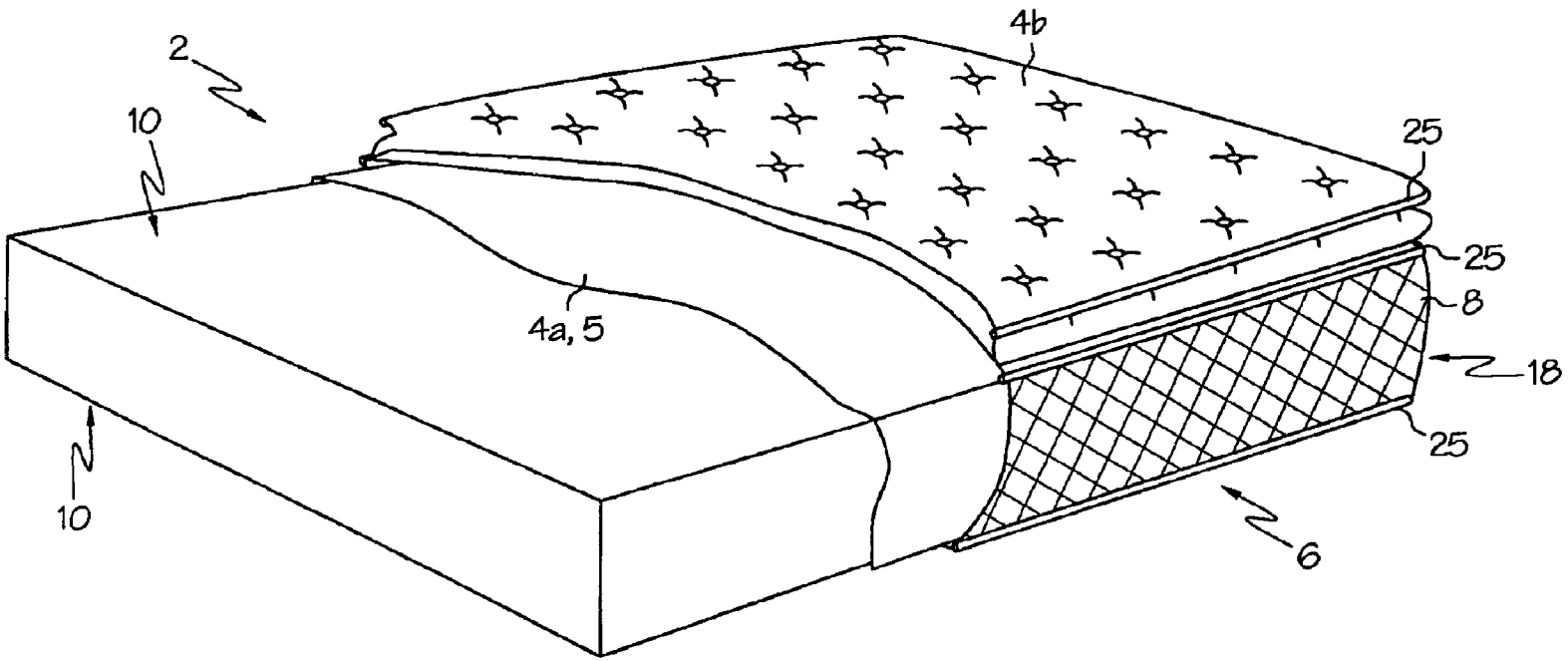
FIG. 3 is a schematic, perspective view of a pillow top, anti-microbial/-allergenic mattress shown in accordance with another embodiment of the present invention, which has also been partially cut away for convenience of illustration.

In accordance with another embodiment, as illustrated in FIG. 3, the present invention further defines a pillow-top type mattress 2 having an inner top panel 4*a*, an outer top panel 4*b* that forms the pillow-top assembly, and a bottom panel 6 that is hidden from view. The outer top panel 4*b* is secured to the border 8 around its outer periphery. As in the non-pillow type mattress 1 described above, the border 8 is positioned around the outer perimeter of the mattress 2, forming a lateral side 18 between the inner top panel 4*a* and the bottom panel 6, which is joined with the inner top and bottom panels 4*a*, 6 sealing the interior components of the mattress 1 therein. The peripheries of the inner and outer top panels 4*a*, 4*b*, and bottom panel 6, can define tape binding or edging 25 that is used to form welts. The outer top and bottom panels 4*b*, 6 as well as the border 8 can all be manufactured from the same chemical-free, 100% cotton damask material described above, which material can be pre-cut for standard mattress sizes prior to assembly.

In accordance with the present embodiment, the pillow top mattress 2 comprises the same components and materials as the non-pillow top mattress 1 described herein, except that the inner top panel 4*a*, which is ordinarily a versere or non-woven material in a conventional pillow top mattress, is manufactured from the barrier layer 5. The inner top panel 4*a* can be attached to the mattress 2 by securing the flanges 7 to the coil springs 22 using hog rings 17 or other like fasteners. When the mattress 2 is closed during the tape edging and serging process, the barrier layer 5 is attached to the border 8 and bottom panel 6 by serging, and the coil spring system 12, latex foam 10, and other optional filling materials are sealed within the layer 5, which forms an anti-microbial/-allergenic barrier. The outer top panel 4*b* is then serged along its outer periphery to the border 8, forming the pillow top.

Figure 4:
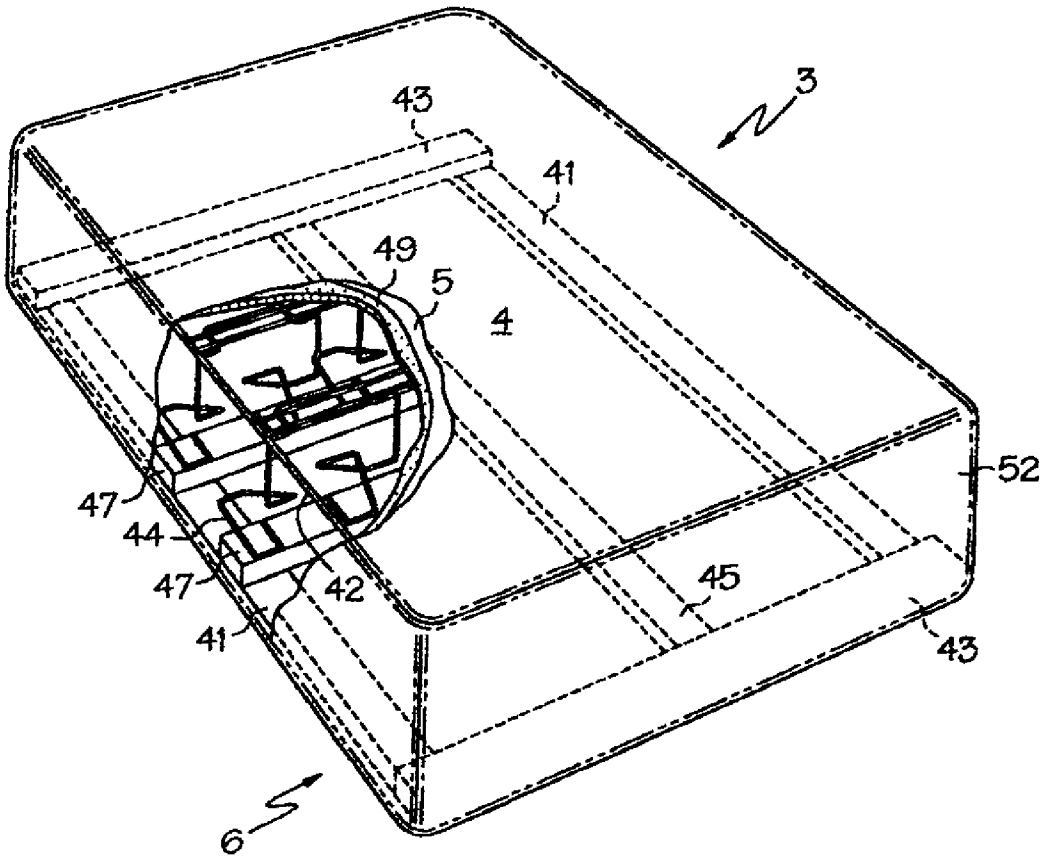
FIG. 4 is a schematic, perspective view of an anti-microbial/-allergenic box spring shown in accordance with another embodiment of the present invention, which has been partially cut away for convenience of illustration.

Referring now to FIG. 4, in accordance with yet another embodiment of the present invention, a box spring 3 is provided comprising certain structural components that are typically employed in manufacturing of box springs such as a substantially rectangular frame, which frame comprises side 41 and end rails 43, a center rail 45, and a plurality of cross rails 47 that are generally parallel to each other and to the end rails 43, and are substantially perpendicular to the side rails 41. The box spring 3 can also include a substantially rectangular wire mattress support deck 42 positioned above the frame and a plurality of wire springs 44 that are mounted on the cross rails 47 and end rails 43 and connected to the deck 42 so as to resist downwardly directed bedding loads. The box spring 3 further defines a box cover comprising a top and bottom panel 4, 6, which is serged to a barrier layer 5 around its outer periphery. The barrier layer 5 is manufactured from the synthetic, anti-microbial/- allergenic material that is described herein. A border 8 is serged to the barrier 5 in much the same way as the mattress border, using an automatic border serging machine. The box spring 3 is upholstered with a natural, non-allergenic pad 49. Accordingly, as in the mattresses 1, 2 described herein, the barrier layer 5 encapsulates the frame, wire springs 44 and pad 49, creating a sealed box spring 3 that is impermeable by micro-allergens. Unlike after-market encasings and covers of the prior art, the barrier layer 5 is incorporated within the box spring 3 (serged to the inside of the top and bottom panels 4, 6 and border 5) during manufacturing.

In accordance with still another embodiment, the mattress 1 or 2 and box spring 3 of the present invention can comprise a complete sleep set having either pillow top or non-pillow top configurations. In addition, it is contemplated that the mattresses 1, 2 or box spring 3 of the present invention can be paired with conventional mattresses or box springs, in accordance with particular applications and specifications. By employing the processes of the present invention, wherein a chemical-free, 100% cotton outer material is made to surround an anti-microbial/-allergenic barrier and optional natural rubber foam upholstery, a truly allergy-free sleep set is provided.

In order that the invention may be more readily understood, reference is made to the following example, which is intended to illustrate the invention, but not limit the scope thereof.

EXAMPLE 1

An apparatus based on the design reported by Vaughan, J W et al. (JACI 1999; 103:227–231) was used to test allergen barrier properties of fabrics (see Table 2 below). Airflow measurements were calibrated against a fabric control with a known airflow rate. Five hundred milligrams of a dust sample with known amounts of the indicated allergens were pulled across each fabric. A filter cassette mounted downstream from the fabric collected any allergen that was able to penetrate the fabric. The filter was extracted in 2.0 mL of 1% BSA in PBS-Tween 20 overnight. The extract was assayed the following day with an ELISA for the relevant allergen. When the results of this airflow test for a fabric are less than 0.31 ng detected for feline allergen (Fel d1) and 1.3 ng detected for dust mite allergen (Der f1), it can be concluded that the fabric being tested is an effective barrier to Fel d1 and Der f1 allergen transfer.

TABLE 2

Allergen Barrier Testing with Airflow Device

| Sample ID | Airflow through fabric (L/min.) | Fel d1 (ng) | Der f1 (ng) |
|---|---|---|---|
| Allersoft ™ Poly/Cotton | 34.9 | 3.20 | <1.3 |
| Narcote ™ 800 TU | 0 | <0.31 | <1.3 |
| Narcote ™ 404 TU | 0 | <0.31 | <1.3 |
| High fabric control | 35.0 | 1632 | 13.8 |
| Low fabric control | 33.0 | 6.72 | <1.3 |
| Dosed dust control | n/a | 8982 | 1015 |

While the invention has been described by reference to certain preferred embodiments, it should be understood that numerous changes could be made within the spirit and scope of the inventive concepts described. Accordingly, it is intended that the invention not be limited to the disclosed embodiments, but that is have the full scope permitted by the language of the following claims:

I claim:

1. A mattress comprising:

a support apparatus;

a top panel having an interior facing side, wherein said top panel is positioned above said support apparatus;

a bottom panel having an interior facing side, wherein said bottom panel is positioned below said support apparatus;

a border positioned around said support apparatus and attached to said top panel and said bottom panel, wherein said border has an interior facing side;

a foam layer positioned between said support apparatus and said top and bottom panels;

a barrier layer comprising a material configured to be impermeable by allergens, wherein said barrier layer is attached at its outer periphery to said interior facing sides of said top panel, said bottom panel, and said border; and at least one flange configured to secure said top panel, said bottom panel, or said border to said support apparatus.

2. The mattress of claim 1, wherein said support apparatus comprises a plurality of coil springs.

3. The mattress of claim 2, wherein said flange is secured at one terminal end to said coil spring.

4. The mattress of claim 1, wherein said flange is attached at one terminal end to said top panel, said bottom panel, or said border.

5. The mattress of claim 1, wherein said top panel, said bottom panel, and said border are each comprised of cotton material.

6. The mattress of claim 5, wherein said cotton material defines a damask pattern.

7. The mattress of claim 1, wherein said foam comprises a latex emulsion.

8. The mattress of claim 1, wherein said barrier layer comprises a synthetic material.

9. The mattress of claim 8, wherein said synthetic material comprises a plurality of polyester fibers.

10. The mattress of claim 1, wherein said barrier layer further comprises a laminate, and wherein said laminate comprises a synthetic thermoplastic polymer.

11. The mattress of claim 1, further comprising a grid, said grid positioned between said support apparatus and said foam layer.

12. The mattress of claim 11, wherein said grid comprises a metallic or polymeric material.

13. The mattress of claim 1, wherein said mattress is a pillow top mattress further comprising:

an inner top panel secured to said border; and an outer top panel secured to said border and configured to form a pillow top assembly.

14. The mattress of claim 13, wherein said outer top panel is comprised of cotton material.

15. The mattress of claim 14, wherein said cotton material defines a damask pattern.

16. The mattress of claim 13, wherein said inner top panel comprises said barrier layer.

17. A process of forming a mattress having an allergen-impermeable barrier layer incorporated within comprising:

providing a support apparatus having top and bottom surfaces;

providing a layer of foam and positioning said foam adjacent said top and bottom surfaces of said support apparatus;

providing a top panel having an interior facing side and a first flange attached, a bottom panel having an interior facing side and a second flange attached, and a border having an interior facing side;

serging said barrier layer at its outer periphery to said interior facing sides of said top panel, said bottom panel, and said border;

securing said top and bottom panels above and below said support apparatus and said foam layer, respectively, by securing said first and second flanges to said support apparatus; and closing said mattress by attaching said border to said top and bottom panels by serging, thus enclosing said support apparatus and said foam layer within said barrier layer.

18. The process of claim 17, wherein said foam comprises a latex emulsion.

19. The process of claim 17, wherein said barrier layer comprises a synthetic material.

20. The process of claim 19, wherein said synthetic material comprises a plurality of polyester fibers.

21. The process of claim 17, wherein said barrier layer further comprises a laminate, and wherein said laminate comprises a synthetic thermoplastic polymer.

22. The process of claim 17 further comprising:

providing an inner top panel having a first flange attached, wherein said inner top panel comprises said barrier layer;

securing said inner top panel above said support apparatus and said foam layer, respectively, by securing said first flange to said support apparatus;

closing said mattress by attaching said border to said inner top and bottom panels by serging, thus enclosing said support apparatus and said foam layer within said barrier layer; and providing an outer top panel and securing said outer top panel to said border forming a pillow top.

* * * * *